US010300733B1

(12) United States Patent
Maresh

(10) Patent No.: US 10,300,733 B1
(45) Date of Patent: May 28, 2019

(54) WRITING INSTRUMENT WITH SPOOL VALVE

(71) Applicant: Joseph D Maresh, West Linn, OR (US)

(72) Inventor: Joseph D Maresh, West Linn, OR (US)

( * ) Notice: Subject to any disclaimer, the term of this patent is extended or adjusted under 35 U.S.C. 154(b) by 0 days.

(21) Appl. No.: 15/866,430

(22) Filed: Jan. 9, 2018

Related U.S. Application Data

(63) Continuation-in-part of application No. 14/799,366, filed on Jul. 14, 2015, now Pat. No. 9,862,224.

(51) Int. Cl.

| | |
|---|---|
| ***B43K 5/18*** | (2006.01) |
| ***B43K 29/10*** | (2006.01) |
| ***B43K 8/02*** | (2006.01) |
| ***B43K 5/02*** | (2006.01) |
| ***B43K 7/02*** | (2006.01) |

(52) U.S. Cl.
CPC ..... *B43K 5/1827* (2013.01); *B43K 5/025* (2013.01); *B43K 7/02* (2013.01); *B43K 8/024* (2013.01); *B43K 29/10* (2013.01)

(58) Field of Classification Search
CPC ..... B43K 5/1827; B43K 29/10; B43K 8/024; B43K 7/10; B43K 5/025; B43K 5/10; B43K 7/02; B43K 5/14; B43K 5/145
See application file for complete search history.

(56) References Cited

U.S. PATENT DOCUMENTS

| | | | | | |
|---|---|---|---|---|---|
| 1,042,726 | A * | 10/1912 | Tolles | A46B 11/0013 | 401/154 |
| 1,797,465 | A * | 3/1931 | De Biasi | B43K 5/18 | 401/45 |
| 2,130,978 | A * | 9/1938 | White | B43K 27/08 | 401/45 |
| 2,511,369 | A * | 6/1950 | Petit | B43K 7/02 | 401/217 |
| 7,850,385 | B2 * | 12/2010 | Noguchi | B43K 5/025 | 401/198 |

* cited by examiner

*Primary Examiner* — David J Walczak
(74) *Attorney, Agent, or Firm* — Nick A Nichols, Jr.

(57) ABSTRACT

A writing instrument may include an upper pen barrel rotatably connected to a lower pen barrel. A spool valve and fluid reservoirs may be housed in the upper pen barrel. A writing tip secured to the lower pen barrel may be in selective fluid communication with the fluid reservoirs. The upper pen barrel may be rotatable relative to the lower pen barrel of the writing instrument.

13 Claims, 6 Drawing Sheets

WRITING INSTRUMENT WITH SPOOL VALVE

CROSS-REFERENCE TO RELATED APPLICATION

This application is a continuation-in-part of patent application Ser. No. 14/799,366, filed Jul. 14, 2015, now U.S. Pat. No. 9,862,224, which application is herein incorporated by reference in its entirety.

BACKGROUND

The present invention relates to writing instruments, and in particular to writing instruments utilizing colored inks, pigments, and/or dyes in a suspended fluidic state.

Variable color writing instrument may include ball point pens with semi viscous ink, to pens with decreasing ink viscosity ranging from gel pens, roller ball pens, fountain pens, felt tip pens and the like. Applications may range from simple novelty reasons, to continuously blended color ink sketches, to more practical applications whereby a chronological indication may be given to a writing based upon the written word and the color of ink used. In endeavors which may involve skills, such as with color sketches, the ink colors throughout the sketch may be millions of colors, hues, and shades, and the user may create the sketch while controlling and anticipating the color(s) being blended and delivered to the writing tip. For example, while shades of yellow ink are delivered to the writing tip, the user may choose to sketch the sun or yellow objects, and as green ink is introduced, the user may sketch grass and green objects, etc.

In this sense, no two sketches would ever be the same. even if the act of sketching was exactly the same because color variation is inherently highly complex. In another example, notarizing documents or when dealing with legal matters, or even when writing a diary, the ink color of a writing may indicate the chronological order of such written words and the like. If insertions occur out of sequence, the color of such insertions may give an indication as to the general time period such insertions were made, and in this respect the use of color of ink may greatly assist in the prevention of improprieties and forgeries. It may be noted that reblending an identical ink color would be very difficult, and thus forensic document examination may be greatly facilitated. Furthermore, in addition to ink, fluorescent dyes which fluoresce under ultraviolet light or other unusual lighting may be introduced into one or more of the ink colors, such that enhanced color graduations may be visible under UV light.

When dealing with writing fluids such as inks, paints, dyes, and/or pigments, subtractive color theory applies, as opposed to additive color theory where a light source passes through colored filters. Subtractive color theory is that of mixing inks, paints, dyes and/or other natural pigments to make colors that absorb and reflect particular wavelengths of light. For example, for printing, cyan, magenta, and yellow are primary colors. Black may be added for various reasons in a four-color process, most importantly because cyan, magenta, and yellow do not produce "pure" black but more of a dark gray.

Subtractive color theory is based on what light is absorbed. The amount of any color showing will depend on the amount of each of the three primary colors is in a color mixture. Cyan is the opposite of red. Magenta is the opposite of green. Yellow is the opposite of blue. The amount of blue in the final color mixture is directly related to the amount of yellow ink that is in the color mixture. The same is the case for other primary colors. For example, orange is a common color that is generally equal amounts of red and yellow. Adding more yellow will create a lighter orange. Adding red will create a red orange. Green color is a combination of cyan and yellow.

The subtractive color theory starts with the presence of all colors of light, usually as white light reflected from a white surface, such as paper. Dyes or inks may be used to subtract some of the reflected light. Understanding subtractive color theory requires an understanding of how colors of light are subtracted. If yellow dye or ink is applied on a white sheet of paper, one may think that color is added to the paper, but the color is already there; the white paper reflects all colors of light approximately equally. The yellow ink, however, reflects only red and green light and absorbs blue light, thereby subtracting it from the white light. Any color of ink, dye or paint subtracts its complementary color of light. Cyan ink on white paper absorbs red light, and allows green and blue to be reflected. Magenta ink subtracts green light, and allows red and blue to reflect. Yellow ink absorbs blue light, allowing red and green to reflect. Cyan, magenta and yellow are the subtractive primary colors, and combined in pairs, they produce the colors red, green and blue. When all three primary colors are subtractively combined, they subtract all colors of light, leaving black, typically a dark gray is the practical result.

When two primary colors are overlaid, they each subtract one color, allowing only the third color to be reflected. For example, if magenta and yellow ink are mixed or applied on white paper, the magenta ink absorbs green light. The yellow ink subtracts blue light. Neither of them absorbs red light, so red light is reflected by white paper, and a viewer sees the color red. In a sense, the colors experienced in a subtractive color mixture are created in the same way they're created with an additive mixture. A combination of red and green light (where the red and green colors each contain light from one-third of the spectrum) will always produce a yellow-colored light (containing light from two-thirds of the spectrum). It doesn't matter whether one starts with white light and subtracts one-third of the spectrum, or starts with no light (black) and adds two thirds of the spectrum. Similarly, green and blue light always combine to produce cyan-colored light, and red and blue light always combine to produce magenta-colored light. Complementary colors work in similar ways for both additive and subtractive mixtures. In additive mixtures for example, yellow and blue light combine to complete the spectrum, producing white light. In subtractive mixtures, however, yellow and blue produce black (yellow and cyan produce green). Yellow ink subtracts one-third of the spectral light, blue ink subtracts the other two-thirds of the light, resulting in a black color. As previously noted, black is difficult to achieve in the subtractive process, and for that reason a four-color process may be desired in some situations in order to achieve a true black color.

In summary, the subtractive color system involves colorants and reflected light. Subtractive color starts with an object (often a substrate such as paper or canvas) that reflects light and uses colorants (such as inks, pigments or dyes) to subtract portions of the white light illuminating an object to produce other colors. If an object reflects all the white light back to the viewer, it appears white. If an object absorbs (subtracts) all the light illuminating it, no light is reflected back to the viewer and it appears black.

SUMMARY

A writing instrument may include an upper pen barrel rotatably connected to a lower pen barrel. A spool valve and fluid reservoirs may be housed in the upper pen barrel. A writing tip secured to the lower pen barrel may be in selective fluid communication with the fluid reservoirs. The upper pen barrel may be rotatable relative to the lower pen barrel of the writing instrument.

In one instance an object of the writing instrument described herein is to provide a low cost variable color writing instrument capable of full spectrum color.

In another instance an object of the writing instrument described herein is to maximize the words, characters and the like written with the writing instrument before refilling the writing fluid in the fluid reservoirs, and whereby, for example, a user may write substantially more words, characters and the like with a given amount of writing fluid, as compared to existing writing instruments.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION

As used herein the term "fluid" means inks, paints, dyes, pigments, water, alcohol, mixing solutions, surfactants and other flowable fluids suitable for marking on a substrate material, such as paper and the like.

Figure 1:
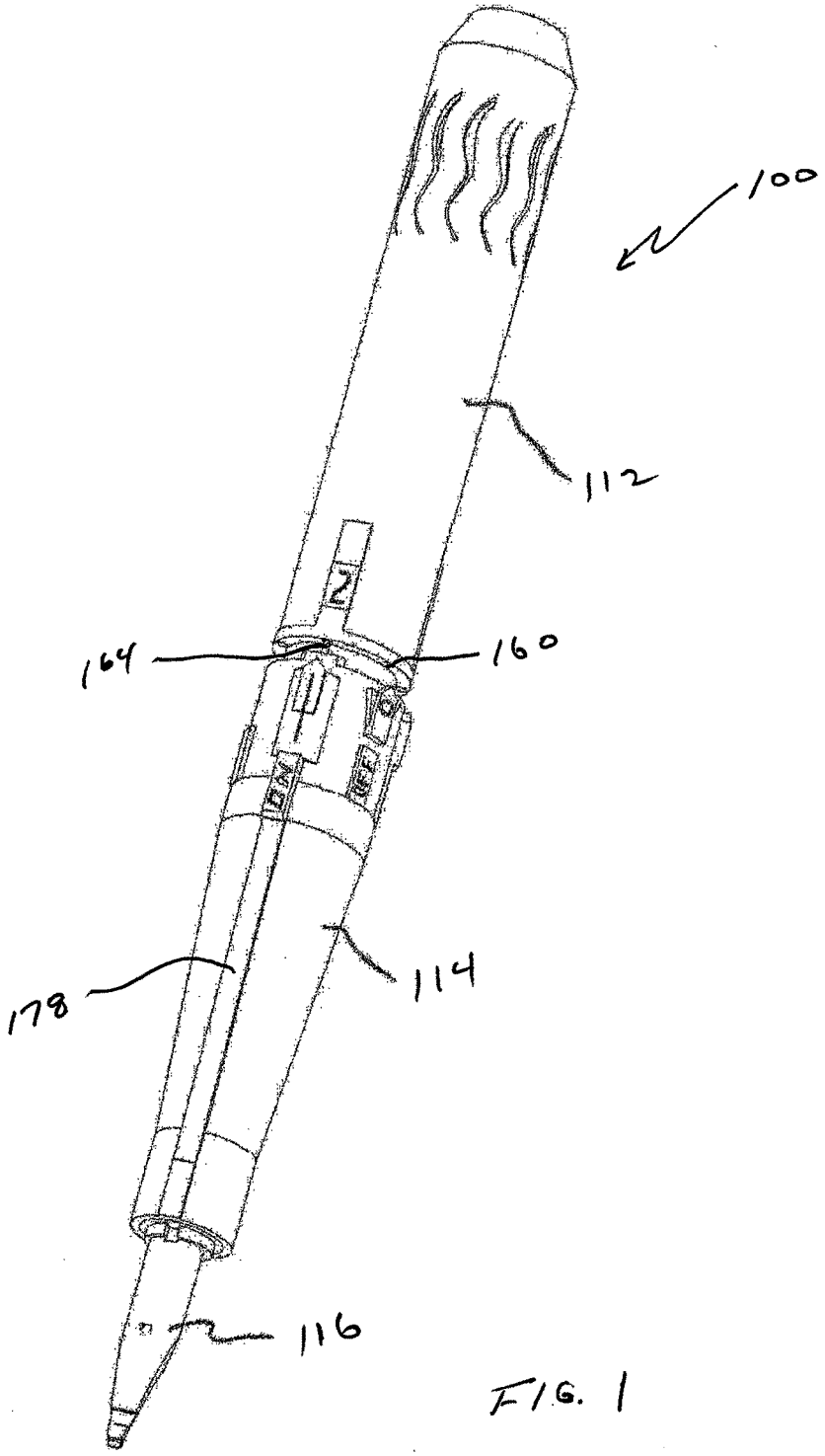
FIG. 1 is a perspective view of a writing instrument.
Figure 2:
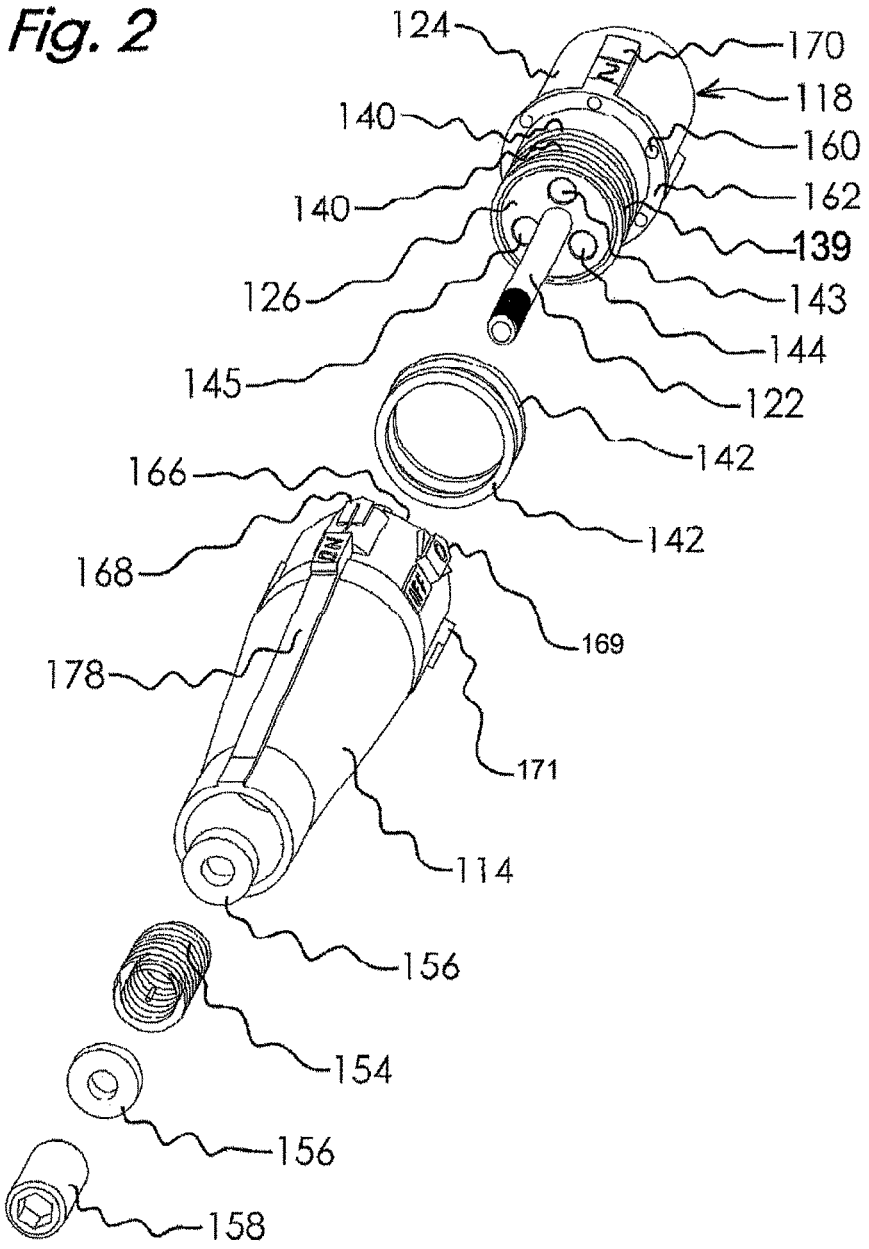
FIG. 2 is a partial exploded perspective view of the writing instrument shown in FIG. 1.

Referring first to FIG. 1, a writing instrument is generally identified by the reference numeral 100. For purposes of illustration, but not by way of limitation, the writing instrument 100 depicted in the drawings is a "fountain pen" and will hereinafter be referred to as a "pen."

The pen 100 may include an upper pen barrel 112 and a lower pen barrel 114 rotatably connected to one another. A writing nib 116 may be removably secured to the lower end of the lower pen barrel 114 in a manner known in the art. As noted above, the pen 100 is not limited to a "fountain pen" and therefore the writing nib 116 may comprise a ball point and/or roller ball point, as well as a felt tip wiring point and the like.

Figure 4:
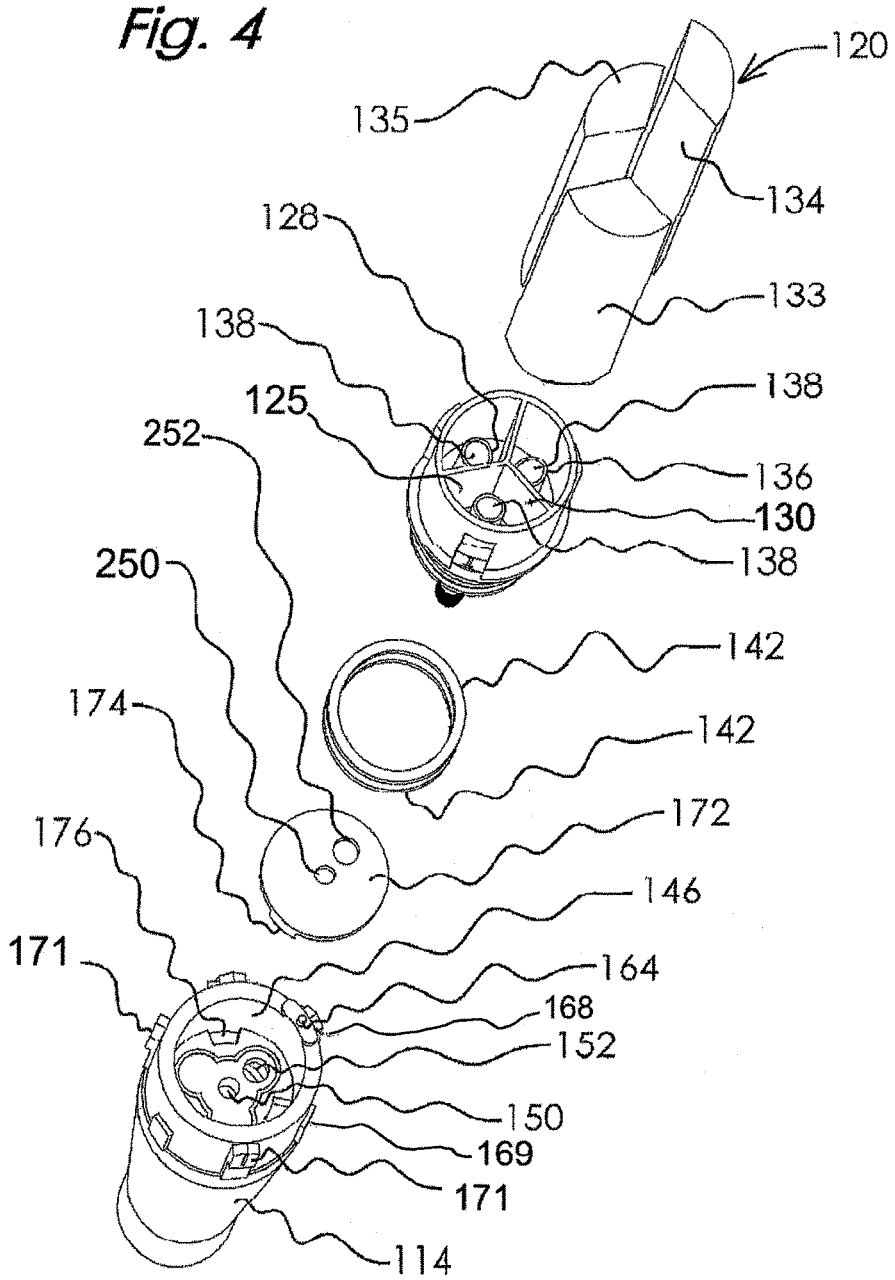
FIG. 4 is a partial exploded perspective view of a second embodiment of a writing instrument.

The upper pen barrel 112 may house a spool valve 118 and an ink cartridge 120 (shown in FIG. 4). An elongated spindle 122 may be fixedly secured to the spool valve 118. The spindle 122 may be coaxial with the longitudinal axis of the spool valve 118 and extend downward from a lower distal end of the spool valve 118.

An upper portion 124 of the spool valve 118 may form a spool cavity 125 open at its upper end and closed at its lower end by a transverse bottom wall 128 (shown in FIG. 4). The spool cavity 125 may be divided by wall members 130 extending upward from the transverse bottom wall 128 to form a plurality of chambers 132. The chambers 132 may include conduits 136 projecting upward from the bottom of the spool body 121 cavity 125. The conduits 136 may define passageways 138 for directing ink from the ink reservoirs 133, 134, 135 to the lower pen barrel 114.

While three chambers 132 are depicted in the drawings, it is understood that the cavity 125 may be divided to include fewer or a greater number of chambers 132 corresponding to the number of ink reservoirs 133, 134, 135 forming the ink cartridge 120. The inner profile of the chambers 132 may correspond to the outer profile or shape of the ink reservoirs 133, 134, 135 so that the ink cartridge 120 may be inserted and retained in the cavity 125 by friction fit connection. The ink reservoirs 133, 134, 135 may each contain a unique ink color. The ink cartridge 120 may comprise an ink cartridge design sealed at the factory and reusable. A user may fill the ink reservoirs 133, 134, 135 with an eyedropper and the like. Alternatively, the ink cartridge 120 may be of a higher quality design with superior seals, etc, and provided to the user empty so that the user may fill the ink reservoirs 133, 134, 135 with ink colors selected by the user. The ink cartridge 120 may be installed by inserting the ink reservoirs 133, 134, 135 into respective chambers 132 onto the conduits 136 and sealed therewith by friction connection between the conduits 136 and respective reservoirs 133, 134, 135.

The spool valve 118 may include a reduced diameter lower portion 139 terminating at a transverse bottom wall 126. The reduced diameter portion 139 may include circumferential grooves 140 for receiving o-rings 142 which may slidably engage with an inner surface of a recessed cavity 146 of the lower pen barrel 114. The o-rings 142 may provide a secondary seal in the event that any ink weeps out and moves along the spool valve 118. However, the o-rings 142 may be omitted if close tolerances are maintained during manufacturing. In any event, one or more o-rings 142 may provide an additional barrier to prevent ink leakage. The ink passageways 138 formed by the conduits 136 may terminate at respective outlet holes 143, 144, 145 in the bottom wall 126 of the reduced diameter portion 139 of the spool valve 118.

Figure 3:
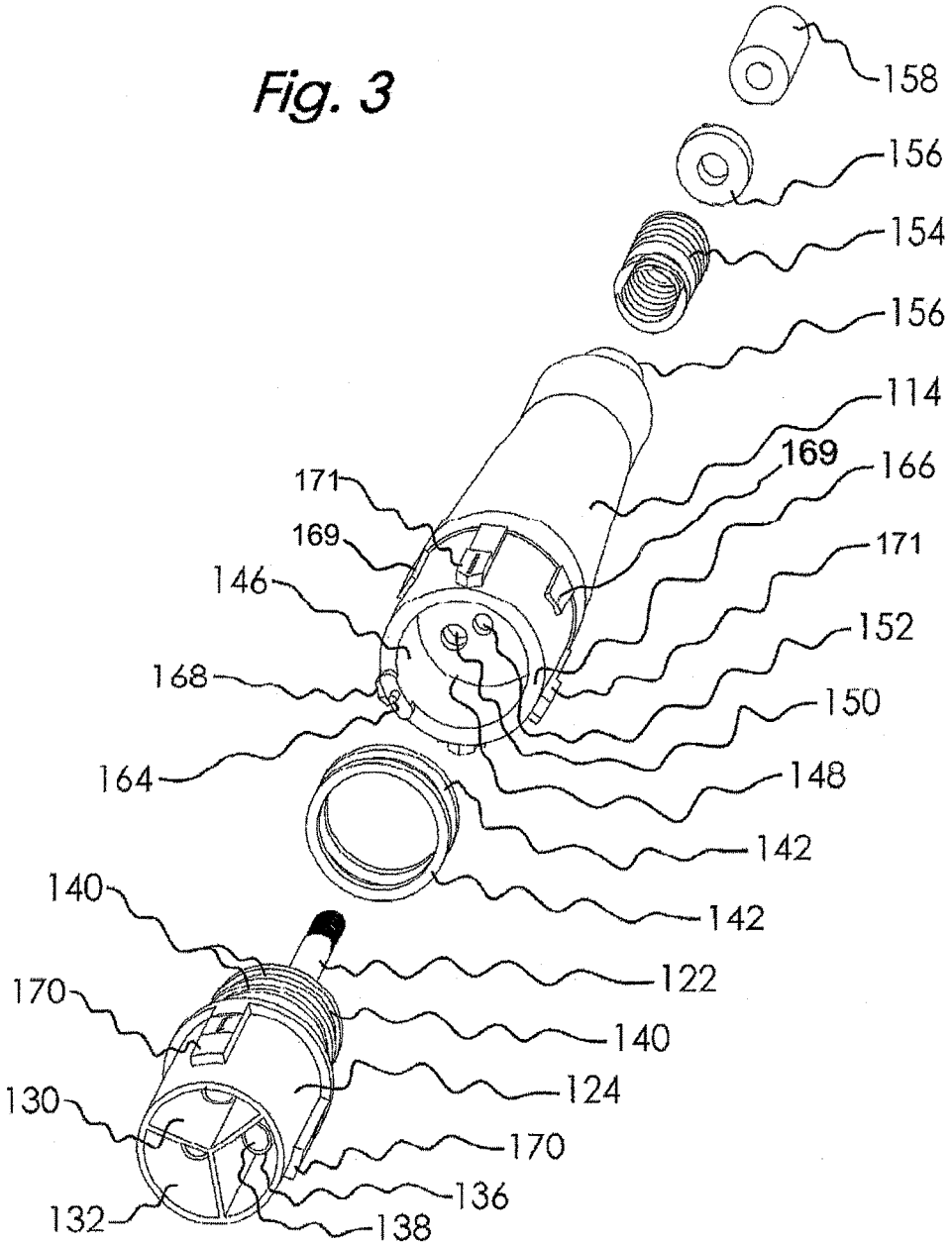
FIG. 3 is a second partial exploded perspective view of the writing instrument shown in FIG. 1.

Referring now to FIG. 3, the lower pen barrel 114 may be configured for mating engagement with the spool valve 118. The upper distal end of the lower pen barrel 114 may define a recessed cavity 146. The bottom of the cavity 146 may be a transverse planar seal 148. The seal 148 may be a "poured in place" seal, such as silicone and the like. The seal 148 may include a spindle hole 150 and an ink pathway port 152 radially offset from the spindle hole 150. Upon assembly of the spool valve 118 with the lower pen barrel 114, the spindle 122 extends through the spindle hole 150 and the reduced diameter lower portion 139 of the spool valve 118 is received in the cavity 146 of the lower pen barrel 114. A spring 154 disposed between washers 156 may be threaded on the spindle 122. A cap nut 158 may be threaded on the spindle 122 and tightened to compress the spring 154 and thereby provide a compressive biasing force against the seal 148 forcing it into facing contact with the bottom wall 126 of the lower portion 139 of the spool valve 118. Typically, the spring 154 may limit and regulate the compressive force at the seal 148 to about 5-10 pounds to ensure a liquid tight rotary connection.

It may be observed that the seal 148 includes a single ink pathway port 152. Ink may be directed to the writing nib 116 by aligning outlet holes 143, 144, 145 in the bottom wall 126 of the spool valve 118 with the ink pathway port 152 by rotating the spool valve 118 relative to the lower pen barrel 114. Detents 160 may be provided in the circumferential shoulder 162 circumscribing the reduced diameter lower portion 139 of the spool valve 118 for accurate alignment of the ink pathway port 152 with any one of the outlet holes 143, 144, 145 of the spool valve 118. The detents 160 may be engaged by a spring-loaded pin 164 fixedly secured to the upwardly facing distal edge 166 of the lower pen barrel 114.

The detents 160 may be arranged about 60° degrees apart so that a tactile and audible indication may be provided at every 60° degrees of rotation of the spool valve 118 relative to the lower pen barrel 114. As there may be periods of time, such as when the pen 100 is not in use or is in transport, it may be desirable to shut off the supply of ink to the writing nib 116. As the outlet holes 143, 144, 145 in the spool valve 118 are equally spaced apart, about 120° degrees, every 60° degrees of rotation of the spool valve 118 relative to the lower pen barrel 114 will either align one of the outlet holes 143, 144, 145 with the ink pathway port 152 or misalign with the ink pathway port 152, and thereby ensure that the flow of ink to the writing nib 116 is shut off. As each detent 160 aligns with the spring-loaded pin 164 a "click" may be heard indicating that ink flow to the writing nib 116 is "on" or "off."

A visual indication as to whether the pen 100 is in the "on" or "off" position may also be provided. Alignment tabs may be fixedly secured about the periphery of the lower pen barrel 114 proximate the distal edge 166 thereof. Upon alignment of the "on" tab 168 with one of the indicators 170 fixedly secured about the periphery of the upper portion 124 of the spool valve 118, the selected ink color may flow through a respective passageway 138 to the writing tip 116. The indicators 170 may be aligned with the detents 160 corresponding to the "on" or ink flow position. The indicators 170 may be labeled to indicate the corresponding ink reservoir 133, 134, 135 associated with the respective indicator 170. For example, but without limitation, the indicators 170 depicted in the drawings may be labeled "1," "2," and "3" to identify the respective ink reservoirs 133, 134, 135. The user may then easily determine whether a particular ink color in the ink reservoirs 133, 134, 135 is aligned for delivery to the writing nib 116.

When the pen 100 is not in use, one of the indicators 170 may be aligned with an "off" tab 169 fixedly secured about the periphery of the lower pen barrel 114. In the "off" position the ink passageways 138 are misaligned with the ink pathway port 152 so that the flow of ink to the writing nib 116 may be blocked. A tab 171 fixedly secured about the periphery of the lower pen barrel 114 may correspond to position of the lower pen barrel 114 relative to the to the spool 118 where the ink pathway port 152 is always blocked.

Figure 5:
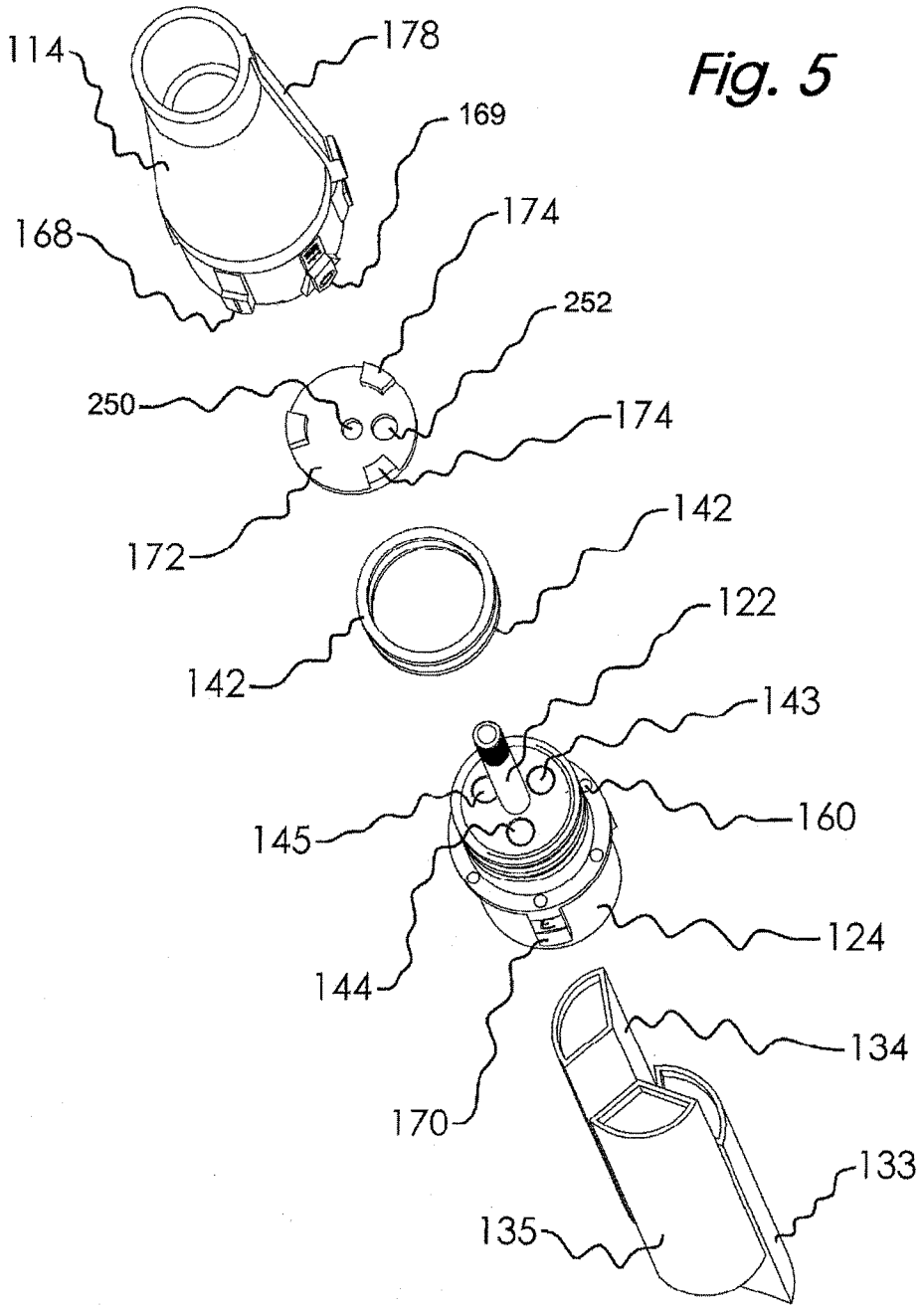
FIG. 5 is a second partial exploded perspective view of the writing instrument shown in FIG. 4.

Referring now to FIGS. 4 and 5, an alternate embodiment of the pen 100 may include a seal disc 172 which is pre-molded or cast to the appropriate shape to fit in cavity 146 of the lower pen barrel 114. The seal disc 172, may for example, be 60 Shore A silicone, or a cast and polished ceramic material. The seal disc 172 may include a spindle hole 250 and an ink pathway port 252 radially offset from the spindle hole 250. The seal disc 172 may be provided with various contours, including bosses 174, or splines and the like so that when installed the seal disc 172 does not rotate relative to the lower pen barrel 114. For example, but without limitation, the bottom wall of the recessed cavity 146 may be provided with recesses 176 so that the bosses 174 may nest therein and secure the seal disc 172 in the cavity 146 of the lower pen barrel 114.

The lower pen barrel 114 may include a ridge 178 on the exterior surface thereof. The ridge 178 may be generally oriented upward to facilitate downward flow of ink and upward passage of air as the ink in each of the reservoirs 134 is consumed and displaced with air. The orientation of the ridge 178 may not be of consequence for ball point pen designs and inks having a relatively higher viscosity.

Figure 6:
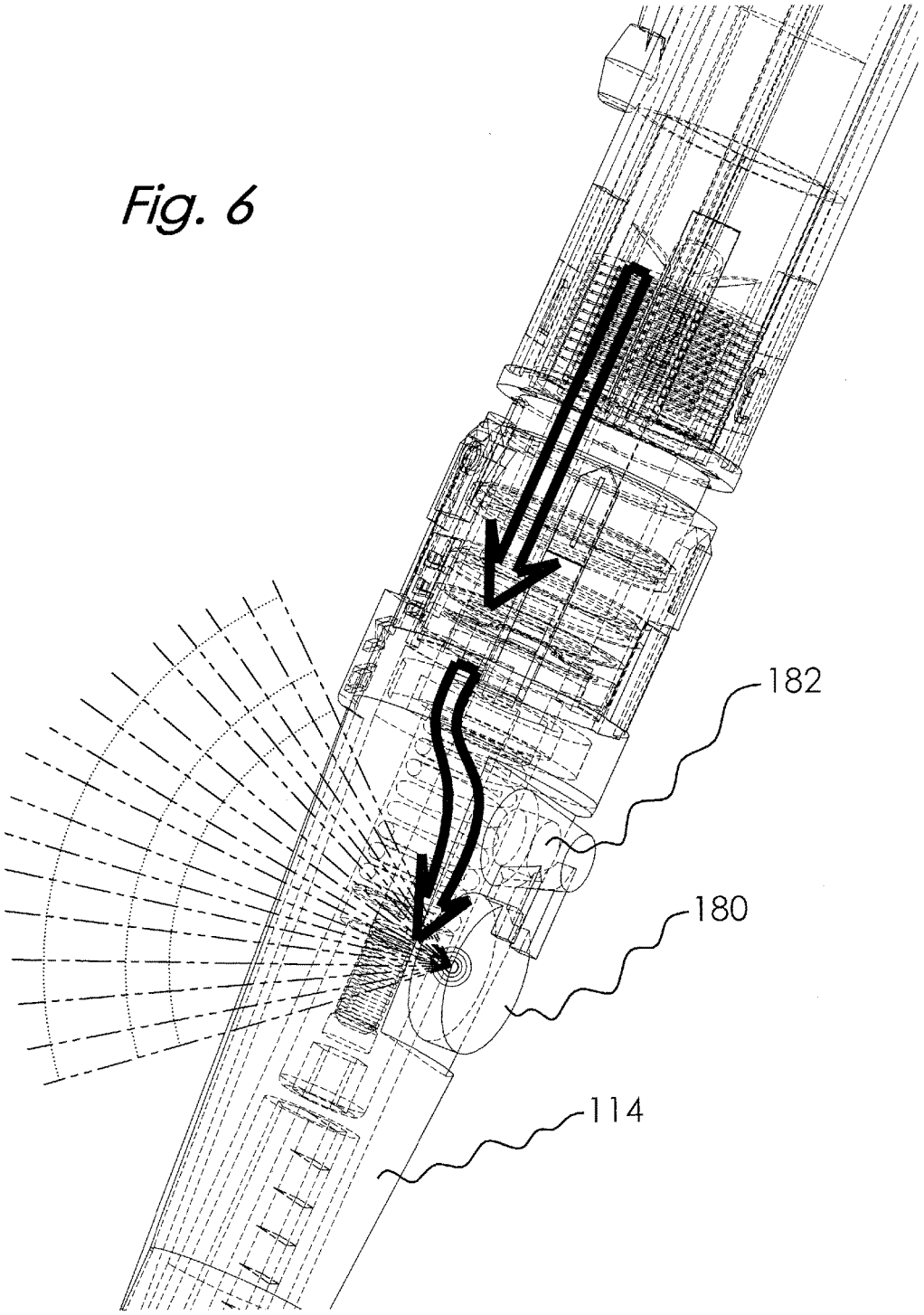
FIG. 6 is a partial perspective view of a writing instrument showing hidden lines and a viewing portion of the writing instrument.

Referring now to FIG. 6, the lower pen barrel 114 of the pen 100 may include a transparent portion. An LED light 180 and a battery 182 may be imbedded in the transparent portion of the lower pen barrel 114. The light 180 may illuminate the region of the lower pen barrel 114 where mixing of the ink colors may occur, thereby permitting the user to view the color of the ink mixture flowing toward the writing nib 116.

The pen 100, as noted above and depicted in the drawings, is a fountain type pen for illustrative purposes only. It is understood that the pen 100 described herein may include, but is not limited to, ball point pens with viscous ink (considered paste), pens with generally decreasing ink viscosity ranging from tempura pens, gel pens, roller ball pens, brush tip pens, fountain pens, stylus pens, and/or felt tip pens, of both water or alcohol base and the like.

The pen 100 may be suitable for a wide range of uses such as a simple novelty item to being able to continuously and smoothly cause a transition of colors while creating a drawing, sketch and the like, and where no two sketches or drawings are identical, even with identical pen motions, because of the somewhat turbulent flow and the complex nature of the physics of a flowing fluid. Viscosity alone is a complex and somewhat chaotic factor to consider, as well as the dynamics of the spool valve or other valves, such as disk valves or pinch valves.

The subtractive color system, described in greater detail hereinabove, applies to the pen 100. The full color spectrum may be possible with the ink colors magenta, yellow, and cyan. Generally, pen 100 may be considered a "color shifting pen" utilizing three reservoirs (or three cartridge) of compatible or mixable inks. Color shifting pens may be controlled with the spool valve described hereinabove. The pen 100 may be used for various purposes, such as, notarizing documents or dealing with legal matters, or even writing a diary. The chronological order of the written words, characters and the like may be determined by the ink color. If insertions occur out of sequence, the color of such insertions provides an indication as to the general time period, based upon the ink color, that such insertions were made. In this respect, the use of color may greatly assist in the prevention of fraud and forgeries. Note that it would be very difficult to re-blend the identical ink color. Forensic document examination may also be greatly facilitated. The reader will note that the chronological order is not actually a function of time, but rather a function of the number of words, characters and the like the pen has written. Furthermore, in addition to ink, fluorescent dyes which fluoresce under ultraviolet light may be introduced into one or more of the reservoirs, for example, in order to introduce unique graduations which would only be visible under UV light.

Continuing again with ink mixtures, the ink colors throughout a sketch, drawing or writing are a smooth transition of many colors, hues, and shades. A user may create the sketch or drawing while controlling and anticipating the colors being mixed and/or blended and delivered to the writing tip. For example, while shades of yellow are being delivered to the writing tip, the sun or yellow objects may be sketched, and as the user introduces green blended ink, then plants and/or green objects may be sketched. Furthermore, during color mixing, and particularly when utilizing fountain pens, it should be noted that the quantity of ink colors available in the market is high, and the user may elect to deviate from the three subtractive primary colors discussed above and select non-primary colors which, for example, may result in mixtures of pastel colors. Alternatively, scarlet, purple and/or green ink may be included in at least one of the reservoirs to emphasize a particular mixable range of colors. Also, for steady delivery of a mixed color or shade, positioning the spool valve to a predetermined intermediate position between two fluid reservoirs, both in the "on" mode in some portion (throttling), steady state mixing action may occur while writing.

All colors are possible with the three reservoir configuration of the pen 100 where the primary subtractive colors are provided. With regard to secondary colors, if the primary subtractive colors of yellow, cyan, and magenta are provided, then a secondary color such as red, green or blue may be mixed and delivered to the pen mixing chamber, and once such a color is in the mixing chamber, a new primary color may be introduced resulting in colors such as violet, rose, orange, chartreuse green, spring green, and azure to be mixed within the pen mixing chamber and thereafter delivered to the writing tip. Further variations when combining tertiary and secondary colors, or tertiary and tertiary colors, or any combination of the above colors are also possible, thus enabling a remarkably wide variation of the number of colors, shades and hues which may be gradually mixed within the pen mixing chamber during the act of writing.

While various embodiments of the invention have been shown and described herein, other and further embodiments of the invention may be devised without departing from the basic scope thereof, and the scope thereof is determined by the claims which follow.

The invention claimed is:

1. A writing instrument, comprising:

a) an upper pen barrel and a lower pen barrel;

b) a spool valve connecting said upper pen barrel to said lower barrel;

c) a writing tip removably secured to a lower distal end of said lower pen barrel;

d) an ink cartridge removably received in a spool cavity of said spool valve, said ink cartridge including a plurality of ink reservoirs in fluid communication with said writing tip; and e) said lower pen barrel including an ink pathway port, wherein rotation of said spool valve relative to said lower pen barrel aligns a respective one of said ink reservoirs with said ink pathway port.

2. The writing instrument of claim 1 wherein said spool valve includes a reduced diameter portion and a spindle extending downwardly from said reduced diameter portion.

3. The writing instrument of claim 2 including a transverse wall extending across a distal end of said reduced diameter portion of said spool valve, a plurality of fluid passageways extending from said ink reservoirs terminating at respective outlet holes in said transverse wall.

4. The writing instrument of claim 3 wherein said lower pen barrel includes a recessed cavity extending from an open upper end of said lower pen barrel, a lower end of said recess cavity defined by a seal having a planar surface extending transverse to a longitudinal axis of said lower pen barrel, said seal including a center hole concentric with the longitudinal axis of said lower pen barrel and a fluid pathway port offset from said center hole wherein said spindle extends through said center hole of said seal.

5. The writing instrument of claim 4 including a biasing member threaded on said spindle and a nut threaded on a distal end of said spindle abutting said biasing member.

6. The writing instrument of claim 5 wherein rotation of said spool valve relative to said lower pen barrel aligns one of said fluid passageways with an ink pathway port in said lower pen barrel establishing fluid communication between said writing tip and a respective one of said ink reservoirs.

7. The writing instrument of claim 4 wherein said seal includes an ink pathway port offset from said center hole.

8. The writing instrument of claim 2 including a plurality of detents formed in a circumferential shoulder circumscribing said reduced diameter portion of said spool valve, said detents configured to receive a spring-loaded pin mounted on a distal end of said lower pen barrel.

9. The writing instrument of claim 8 including visual indicators providing visual indication of alignment of a respective one of said fluid passageways with said ink pathway port.

10. The writing instrument of claim 1 wherein said lower pen barrel includes a transparent portion.

11. The writing instrument of claim 10 including a battery powered light embedded in said transparent portion of said lower pen barrel to illuminate a region of said lower pen barrel where mixing of ink colors occurs.

12. The writing instrument of claim 1 including a seal disc configured for receipt in a recessed cavity extending from an open distal end of said lower pen barrel, said seal disc including a center hole and a fluid pathway port radially offset from said center hole.

13. The writing instrument of claim 1 including a ridge on an exterior surface of said lower pen barrel, said ridge defining an air passage in fluid communication with said ink cartridge.

* * * * *